United States Patent [19]

Ramsey

[11] Patent Number: 5,027,587

[45] Date of Patent: Jul. 2, 1991

[54] METHODS AND APPARATUS FOR CONTROLLING AN INSERTER

[75] Inventor: James S. Ramsey, Shelton, Conn.

[73] Assignee: Pitney Bowes Inc., Stamford, Conn.

[21] Appl. No.: 577,724

[22] Filed: Sep. 5, 1990

[51] Int. Cl.[5] ..... B65B 57/10; B65B 5/06

[52] U.S. Cl. ..... 53/493; 53/77; 53/131.1; 53/266.1

[58] Field of Search ..... 53/493, 500, 499, 498, 53/55, 52, 266 A, 131, 77

[56] References Cited

U.S. PATENT DOCUMENTS 4,716,711 1/1988 Signoretto ..... 53/266 A X 4,733,359 3/1988 Luperti et al. ..... 53/266 A X 4,739,606 4/1988 Cantile ..... 53/493

4,962,623 10/1990 Francisco ..... 53/266 A X

*Primary Examiner*—James F. Coan

*Attorney, Agent, or Firm*—Donald P. Walker; Melvin J. Scolnick; David E. Pitchenik

[57] ABSTRACT

Apparatus for processing sheets, comprising: structure for feeding sheets in a downstream path of travel; at least two structure for supporting sheets located adjacent to said path of travel; each of said supporting structure having stacked therein a plurality of sheets; at least one of said sheet supporting means including electronic structure for storing data relating to each sheet therein; and structure for controlling operation of the apparatus; and said controlling structure including structure for causing said data to be stored therein.

26 Claims, 6 Drawing Sheets

METHODS AND APPARATUS FOR CONTROLLING AN INSERTER

BACKGROUND OF THE INVENTION

This invention is generally concerned with methods and apparatus for processing sheets and more particularly with methods and apparatus for controlling an inserter.

This application is one of the following five related U.S. Patent Applications filed concurrently herewith by James S. Ramsey and assigned to the same Assignee: Ser. No. 07/577,721 for Portable Apparatus For Supporting Sheets; Ser. No. 07/577,712 for Methods of Processing Sheets Having An Order Corresponding to the Order of Stored Data; Ser. No. 07/577,726 for Assembling Apparatus Including Means for Matching Coded Sheets; Ser. No. 07/577,728 for Sheet Processing Apparatus Including Memory Means Removably Connected Thereto; and Ser. No. 07/577,724 for Methods and Apparatus for Controlling An Inserter.

In a typical inserter, which is utilized by large business mailers for preparing mailpieces which include collations of multiple sheets, such as cards, forms, letters, return envelopes and remittance slips, and other sheets, stuffed into envelopes, the first sheet fed into a downstream path of travel for collation with other sheets fed from other feeding stations is marked with a processing code which includes data for controlling the selection of the other sheets. The coded sheet is referred to in the art as a control document and is normally fed into its downstream path of travel from the most upstream sheet feeding station of the inserter. As the control document is fed downstream, the code thereon is successively sensed by conventional sensing structures located at each of the downstream sheet feeding stations, which are known in the art as an insert stations. In response to sensing the code, sheets are fed from one or more of the insert stations for collation with the control document. In some commercially available inserters the sheet feeding path for the control document is the same as that of the insert sheets, whereas in others, the sheet feeding paths for the control document and insert sheets converge at an accumulating and envelope stuffing station, where the control document and selected insert sheets are collated and inserted into a suitable mailing envelope. In either instance, the typical inserter includes as many code sensing structures as there are insert stations, and the control document code is repeatedly scanned to determine whether or not a given insert station has been selected for feeding a sheet for collation with the control document. Moreover, the order in which insert sheets are associated with a given control document is normally determined by the physical order in which the insert stations are located along the downstream path of travel, as a result of which insert sheets are normally stacked in a particular order at the insert stations along the path of travel to insure that properly sequenced collations are prepared. Accordingly:

An object of the invention is to provide improved methods and apparatus for controlling an inserter;

Another object is to provide methods and apparatus for utilizing any sheet feeding station of an inserter, including the mailing envelope feeding station, for use as the source of supply of the processing code for a given collation;

Another object is to provide methods and apparatus for simplifying the structure of an inserter, including permitting the provision of fewer code sensing structures; and Another object is to provide improved methods and apparatus for preparing mailpieces in an inserter.

SUMMARY OF THE INVENTION

Apparatus for processing sheets, comprising: means for feeding sheets in a downstream path of travel; at least two means for supporting sheets located adjacent to said path of travel; each of said supporting means having stacked therein a plurality of sheets; at least one of said sheet supporting means including electronic means for storing data relating to each sheet therein; and means for controlling operation of the apparatus; and said controlling means including means for causing said data to be stored therein.

DESCRIPTION OF THE PREFERRED EMBODIMENTS

Figure 1C:
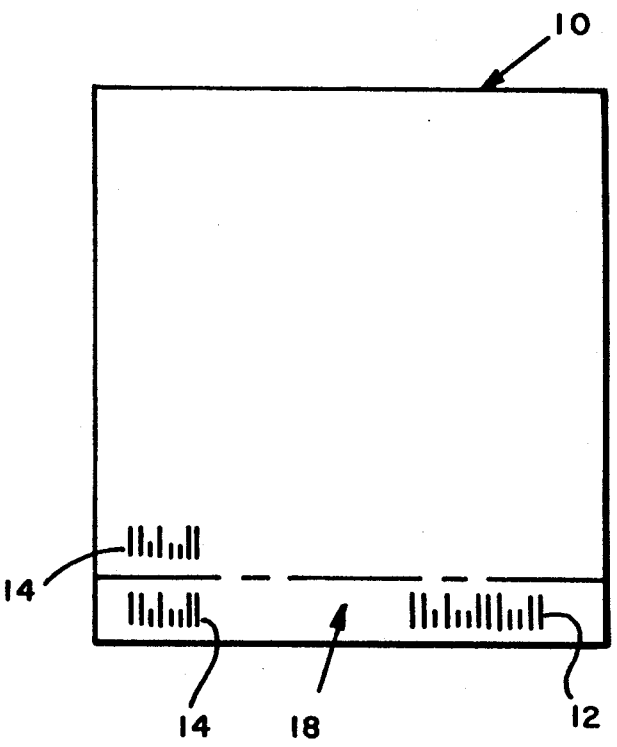
FIG. 1*c* is a plan view of yet another typical sheet, such as a sheet separated from a web, or any other sheet which, prior to processing in accordance with methods and apparatus of the invention, had separated therefrom a coded, marginal edge portion.
Figure 1B:
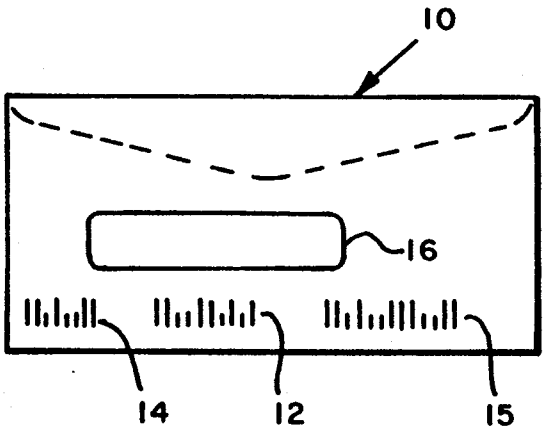
FIG. 1*b* is a plan view of another typical sheet, such as an envelope, with or without a window, which is suitable for processing in accordance with the methods and apparatus of the invention.
Figure 1A:
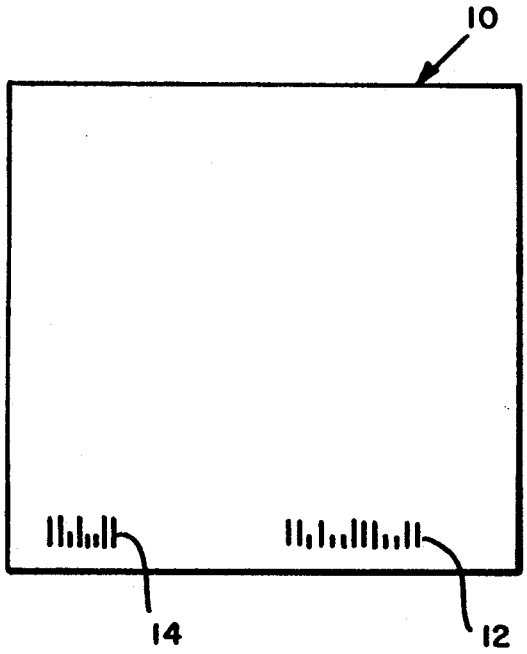
FIG. 1*a* is a plan view of a typical sheet, such as a cut sheet, card, letter, or remittance slip, or other sheet, which is suitable for processing in accordance with the methods and apparatus of the invention.

As shown in FIG. 1*a*, a sheet 10 of the type which may be processed in accordance with the invention may comprise a cut sheet, a card, pre-printed form, letter, remittance slip, or other sheet 10, having either or both a processing or key code, 12 or 14, printed thereon. Although the processing code 12 may be any code, it is preferably a bar code and, in particular, a bar code of the type known in the art as a "three of nine" code, which provides 79,507 different code combinations for corresponding to as many elements of information. Thus the code marked on a given sheet may embody or otherwise comprise data corresponding to information such as a complete address of the addressee of the given sheet 10, including but not limited to a postal bar code representative of the postal zip code corresponding to the mailing address of the addressee, a unique key code identifying the given sheet 10, information pertaining to one or more operations that are to be performed on the sheet in the course of processing the same, including information pertaining to one or more operations that are to performed by one or more of the apparatus modules or the local computer hereinafter described, or information concerning the number and identity of successive sheets which are to be included in a collation with the given sheet 10, and any other suitable information concerning processing the given sheet 10. In addition, in the preferred embodiment, the key code 14 is related to the aforesaid processing code 12 and may be used for identifying the given sheet 10 and used as a pointer by the control structure of the apparatus modules, or the local computer, hereinafter described, or both, for identifying the related processing code 12.

As shown in FIG. 1*b*, another type of sheet 10 that may be processed in accordance with the invention comprises an envelope 10, with or without a conventional window 16 formed therein, and having either a processing or key code, 12 or 14, printed thereon, and, in addition, optionally having a postal bar code 15 printed thereon. The envelope 10 (FIG. 1*a*) may be used in a collation with other sheets 10 or as a stuffing envelope 10.

And, as shown in FIG. 1*c*, a still further type of sheet 10 which may be processed in accordance with the present invention is one that initially had attached thereto a marginal edge portion 18 which was removed before stacking in the sheet supporting structure hereinafter described. In particular, the marginal edge portion 18 of a given sheet 10 may have included a processing or key code, 12 or 14, or both, marked thereon and which was sensed and stored in the memory of the sheet supporting structure hereinafter described to accompany the given sheet 10 stacked therein. The sheet 10 is representative one which was a separated from a web of sheets 10 or, one which was a sheet 10 having a single marginal edge portion 18 separated therefrom as disclosed in the aforesaid co-pending Patent Application of James Ramsey. Moreover, the sheet 10 may or may not include a key code 14 related to the processing code 12.

A system of apparatus 20 (FIG. 2) according to present invention generally includes an inserting module 100 which is constructed and arranged for collating a plurality of sheets 10 (FIG. 1*a*, 1*b* and 1*c*) and stuffing the collation of sheets 10 into an envelope 10 (FIG. 1*b*).

The inserting module 100 (FIG. 2), which is preferably a stand-alone device, includes suitable control structure 102, such as a microprocessor, for controlling the various structures and functions of the module 100 and may include a conventional operator interface 104, having a keyboard, which is conventionally coupled to the control structure 102 for operation thereof in response to input signals from the operator interface 104. Whether or not the module 100 includes an operator interface 104, the control structure 102 is preferably conventionally adapted to include a two-way serial or parallel communication link 106 for conventionally coupling the control structure 102 to an external source, such as the local computer hereinafter described, for operation of the control structure 102 in response to control signals, such as the signal 108, received from the external source. In addition, the control structure 102 preferably includes one or more conventional electrical connectors 110 for removably electrically connecting one or more external memories, such as the memory structure hereinafter described, to the control structure 102. Thus the module 100 is preferably adapted to permit control of the structures and functions thereof from an external source rather than from the operator interface 104.

The inserting module 100 (FIG. 2) also generally comprises one or more of insert feeding structures 114, 116 or 118, each of which includes sheet supporting structure comprising either a conventional tray 120 or the removably connectable sheet supporting structure 122 (FIG. 3) hereinafter described, for supporting a stack of sheets 10, such as a stack of any one of the sheets 10 (FIG. 1*a*, 1*b* and 1*c*) hereinbefore described, or accumulations of such sheets 10, folded or unfolded, which were prepared off-line from the inserter 100, for example as disclosed in the aforesaid co-pending patent application of James Ramsey.

The sheet supporting structure 122 (FIG. 3) comprises an open ended tray 124 including a base wall 126 and a pair of elongate, parallel-spaced, side walls 128. The side walls 128 extend upwardly from the base wall 126 and form therewith a front opening 130, for the entry of sheets 10 into the tray 124, and rear opening 132, for the exit of sheets 10 from the tray 124. In addition, the sheet supporting structure 122 includes at least one and preferably two opposed, movable front and rear walls, 134F and 134R, one of which, i.e., the front wall 134F, is fully shown, and which is fully discussed herein with the thought in mind that the discussion applies with equal force to the rear wall 134R.

Figure 3:
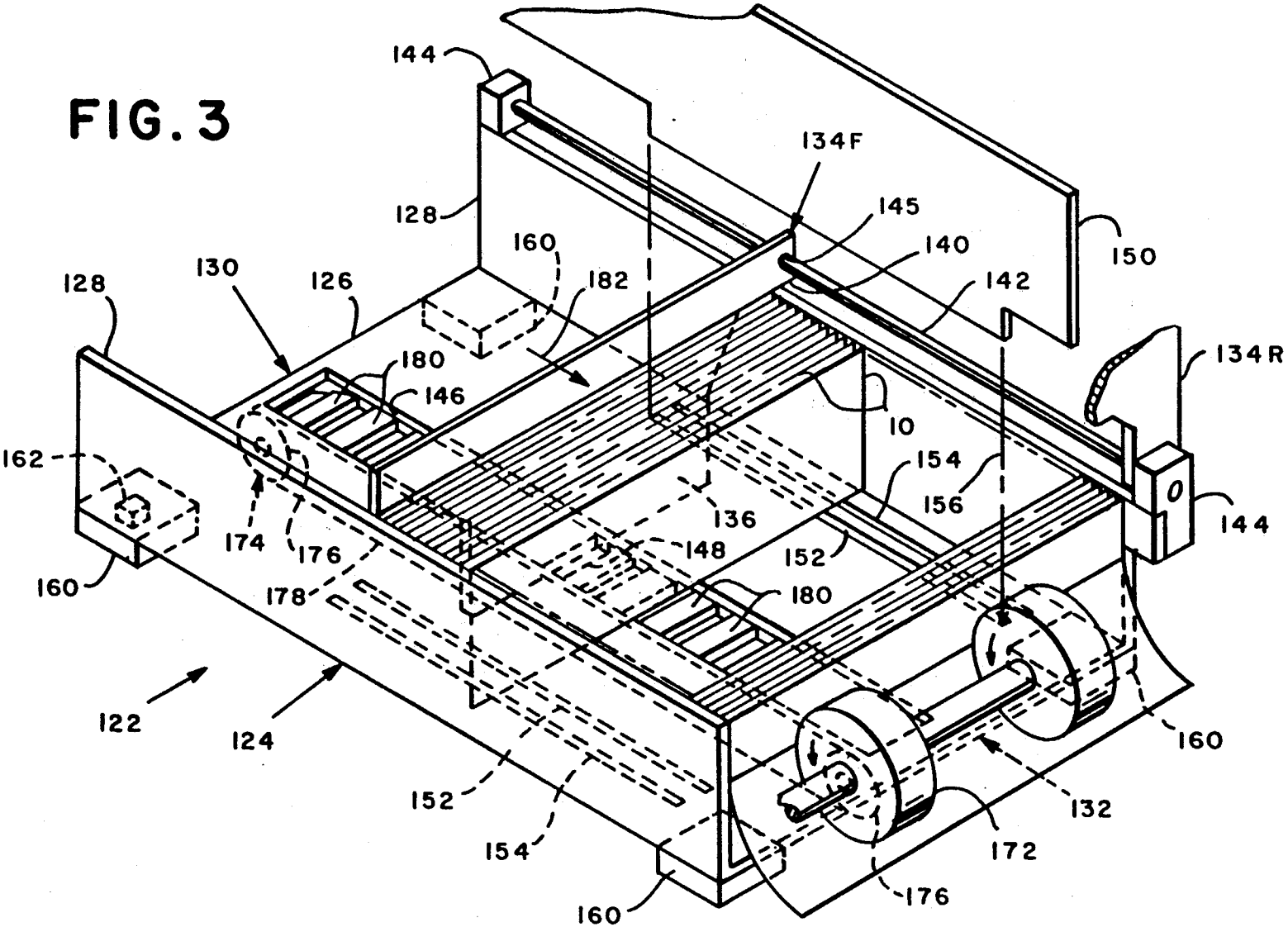
FIG. 3 is a partially schematic, perspective view of sheet supporting structure interfaced with structure for feeding sheets therefrom.

The front wall 134F includes a rectangularly-shaped plate portion 136, which is shown located between the side walls 136, and an arm portion 140 which extends from the upper end of the plate portion 136 and into overhanging relationship with the upper edge of one of the side walls 128. For movably connecting the front wall 134F to tray 124, the sheet supporting structure 122 includes an elongate slide bar 142 having its opposite ends which are suitably connected to the aforesaid one of the side walls 128, as by means a pair of supports 144 which are spaced apart from one another and fixedly connected to the aforesaid upper edge of one of the side walls 128. In addition, the front wall's arm portion 140 is provided with an opening 145 formed therein, which is dimensioned for receiving the slide bar 170 therethrough. And the arm portion 140 of the front wall 134F is both pivotably and slidably mounted on the slide bar 142. As thus constructed and arranged, the front wall 134F is pivotable about the slide bar 142 for moving the plate portion 136 into and out of its location as shown in FIG. 3, i.e., between the side walls 128. Moreover, the front wall 134F is slidably movable along the slide bar 142, forwardly and rearwardly of the tray 124. Thus, assuming the provision of a single transversely-extending sheet supporting wall 134, for example the front wall 134F, and that the front wall 134F is incrementally moved rearwardly from the front opening 130 toward the rear opening 132 as the tray 124 is filled with sheets 10 fed through the front opening 130, then, upon filling the tray 124, the front wall 134F would be disposed adjacent to the tray's rear opening 132. Whereupon the front wall 134F may be pivoted about the slide bar 142, and thus out of its location between the side walls 128, and moved to the position shown in FIG. 3, to permit feeding sheets 1 from the tray 124 and through the rear opening 132. Assuming the provision of both front and rear walls 134F and 134R, the rear wall 134R Would be pivoted out of location from between the walls 128, as shown in FIG. 3, to permit sheets 10 to be fed through the tray's rear opening 132. And, the front wall 134F would be slidably moved to a position wherein it is initially adjacent to the front opening 130 to act as a support for sheets fed from the tray 124. Thus, upon filling the tray 124 the front wall 134F would be pivoted to the position thereof shown in FIG. 3, and the rear wall 134R pivoted out of the position shown in FIG. 3 and into its location between the side walls 128, for holding the stack of sheets 10 in the tray 124 when transporting the sheet supporting structure 122 to the inserting module 100. Moreover, at the inserting module 100. The rear wall 134B would be pivoted to the position thereof shown in FIG. 3, to permit feeding sheets 10 through the tray's rear opening 132, and the front wall would remain in the position thereof shown in FIG. 3.

For guiding the sliding movement of the front wall 134F, the tray's base wall 126 additionally includes an elongate slot 146 which is formed therein substantially midway between the side walls 128, and the front wall's plate portion 136 includes a depending finger portion 148 which extends through the base wall slots 146 and into engagement with the belt hereinafter discussed.

To accommodate stacking sheets 10 (FIG. 3) of different sizes in the tray 124, the sheet supporting structure 122 may additionally include a pair of guide walls 150, one of which is shown. And, the tray's base wall 126 may be provided with one or more pairs of longitudinally extending, parallel-spaced slots, 152 or 154, in which a pair of the guide walls 150 may be removably mounted in parallel-spaced relationship with one another between and parallel to the tray's side walls 128, as exemplified by the arrow 156 showing one of the guide walls 150 being removably mounted in one of the slots 152. In this connection it is noted that assuming the provision of the slots 152 or 154, or both, the front and rear wall portions 136, are preferably dimensioned to fit transversely between the closest pair of slots 152 or 154 that are provided. Still further, the sheet supporting structure 122 includes a plurality of legs 160, one of each of which is located at the one of four corners of the base wall 126. One of the legs 160, i.e., the lower left leg 160 as shown in FIG. 3, acts as or is an electrical connector, dimensioned for engagement with the control structure's electrical connector 110 (FIG. 2), and includes or houses a conventional electronic memory structure 162 (FIG. 3), including any commercially available EEROM, for storing data therein, including a list identifying each sheet 10, and an order in which the sheets 10 are stacked, in the tray 124, and preferably the order of feeding sheets 10 from the tray 124.

Preferably, each of the sheet feeding structures 114, 116 and 118 (FIG. 2) includes conventional feeding structure 170 (FIG. 3) for feeding successive sheets 10 from each of the trays 120 and into a path of travel for collation with other sheets 10. The feeding structure 170 thus includes at least one roller 172, and preferably two, for engaging and guiding sheets 10 one at a time from the sheet supporting structure 122. Moreover, for incrementally rearwardly guiding and moving the rear and front walls 134R and 134F of the tray 124, respectively, in synchronism with sheets 10 being fed from the tray 124, the feeding structure 170 (FIG. 2) preferably Comprises a belt system 174 including a pair of parallel spaced pulley gears 176, and a gear belt 178 which looped about the rollers 176 and disposed in meshing engagement therewith. The gear belt 178 includes, a plurality of gear teeth 180 which are formed in the outer surface of the belt 178 at spaced intervals longitudinally of its length, for receiving therein one of the tray's front or rear wall finger portions 148. As shown in FIG. 3, the front wall finger portion 148 extends downwardly for protrusion through the tray's base wall slot 146, when the sheet receiving structure 122 is connected to the module 100, to permit the finger portion 148, and thus the tray's front wall 134F, to be engaged and moved by the belt 178 in a path of travel 182 which extends lengthwise of the tray 124. As thus constructed and arranged, the sheet feeding structure 170 and the sheet supporting structure 122, are respectively constructed and arranged for operational engagement and disengagement with one another, to permit the sheet supporting structure 122 to be both mechanically and electrically connected to, and disconnected from, the stacking apparatus shown and described in the aforesaid co-pending patent applications of James Ramsey, wherein the sheet supporting structure 122 is filled with a stack of sheets 10, and the inserting module 100 shown in FIG. 2, wherein the sheets 12 stacked in the sheet supporting structure 122 are fed from the sheet supporting structure 122.

Moreover, the inserting module 100 (FIG. 4) includes one or more the envelope feeding structures 190 or 192, or both, each of which includes sheet supporting structure comprising either a conventional tray 194, or one of the sheet supporting structures 122 hereinbefore described, for supporting a stack of envelopes 10 (FIG. 1*b*). In addition, each of the feeding structures 190 or 192, or both preferably includes the sheet feeding structure 170 hereinbefore described for interfacing with sheet supporting structures 122. In addition, the inserting module 100 (FIG. 2) includes conventional sheet accumulating structure 196, including a bin 198, for supporting successive sheets 10 fed thereto from the insert feeding structures 114, 116 and 118. Further, the inserting module 100 includes conventional envelope stuffing structure 200, such as conventional vacuum-type structure, for opening successive envelopes 10 received from the envelope stacking structures 190 or 192, and conventional ram-type structure, for pushing successive accumulations of sheets 10 received from the accumulating structure 200 into such envelopes 10. Still further, the inserting module 100 includes conventional envelope sealing structure 202, such as any conventional envelope flap moistening structure and a pair of opposed pinch rollers, for receiving stuffed envelopes 10 from the stuffing structure 200 and moistening and sealing the flaps thereof. And, the inserting module 100 includes a plurality of conventional feeding structures 204 for feeding insert sheets one at a time along the path of travel, into which they are fed by the respective insert feeding structures 114, 116 and 118, to the accumulating structure 196, feeding accumulations of sheets 10 from the accumulating structure 196 to the stuffing structure 200, and feeding envelopes 10 one at a time along the path of travel, into which they are fed by the respective the envelope feeding structures 190 and 192, to the stuffing structure 200.

Still further, the module 100 (FIG. 2) may include one or more conventional sensing structures 220 which are operatively coupled to the control structure 102 for sensing key codes 14 (FIG. 1*a*, 1*b* or 1*c*) printed on respective sheets 10. Moreover, the module 100 (FIG. 2) includes a plurality of motors 222 and a plurality or drive systems 224 for the feeding structures 114, 116, 118, 190, 192 and 204. And the module 100 includes a plurality of conventional sensors 226 for sensing various positions, at respective time intervals, of the motors 222 and drive systems 224 including their respective home positions. The sensors 220 and 226 are preferably conventionally coupled to the control structure 102 to provide signals, such as the signal 228, to the external source which correspond to the key codes 14 (FIG. 1) printed on the sheets 10 and, as hereinbefore described, to various positions of sheets 10, and of elements of the motors 222 and and drive systems 224.

Figure 2:
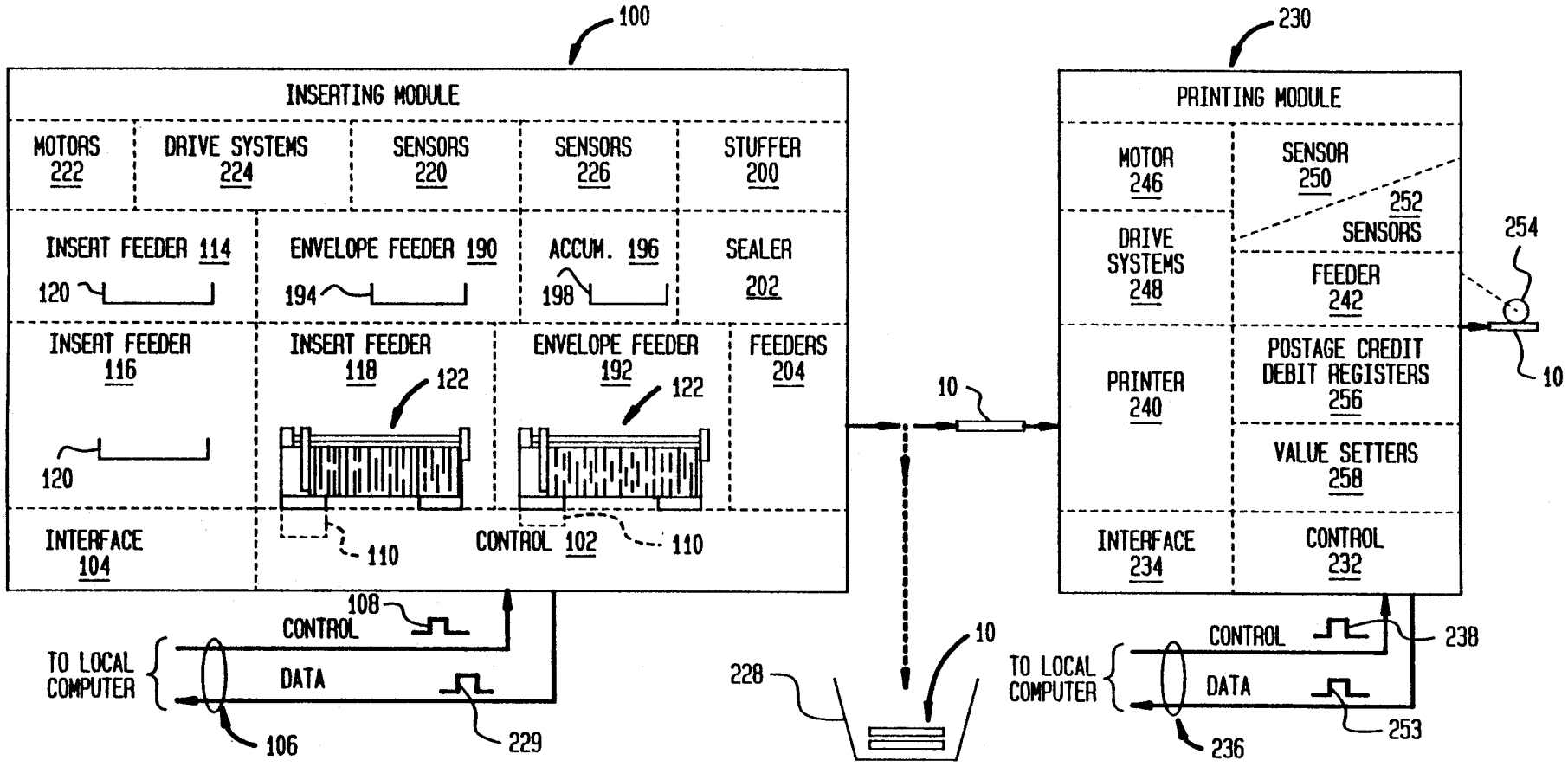
FIG. 2 is a block diagram of a system of apparatus according to the invention, including an inserter module and a printing module adapted to be connected to an external control source.

As shown in FIG. 2, the stuffed envelopes 10 fed from the inserting module may be fed directly to an accumulating bin 228. Alternatively, rather than being fed to the bin 228, it may be desirable to print postage or additional information, such as an address, serial number, run number, batch number, permit mail number, postal zip code or bar code, or other information on the stuffed envelope 10. This being the case, the envelopes 10 from the inserting module 100 would initially be processed by a printing module 230 before further processing.

The printing module 230 (FIG. 2), which is preferably a conventional, stand-alone device, includes suitable control structure 232, such as a microprocessor, for controlling the various structures and functions of the module 230. In addition, the module 230 may include a conventional operator interface 234, such as a keyboard which is conventionally coupled to the control structure 232 for operation thereof in response to input signals from the keyboard. Whether or not the module 230 includes the operator interface 234 the control structure 232 is preferably conventionally adapted to include a two-way serial or parallel communication link 236 for conventionally coupling the control structure 232 to an external source, such as the local computer hereinafter described, for operation of the module 230 in response to control signals, such as the signal 238 received from the external source. Thus the module 230 is preferably adapted to permit control of the structures and functions thereof from an external source rather that from an operator interface 232.

The printing module 230 (FIG. 2) additionally includes conventional printing structure 240, such as any conventional impact, rotary, thermal, ink jet, laser or other commercially available printing apparatus, to which stuffed envelopes 10 are fed from the inserting module 100. In addition, the module 230 includes conventional feeding structure 242. The feeding structure 242 may be any conventional vacuum-type or roller-type structure for engaging and feeding the envelopes 10. Further, the printing module 240 includes a motor 246 and one or more drive systems 248 for the feeding structure 234. The printing module 230 may also includes a plurality of conventional sensing structures 250 for sensing key codes, and postal bar codes, 14 and 15, (FIG. 1*b*) and a plurality of conventional sensors 252 (FIG. 2) for sensing various positions of respective sheets 10, and of the motor 246 and drive systems 248, including their respective home positions, at various time intervals. The sensors 250 and 252 are preferably conventionally coupled to the control structure 232, whereby the control structure 232 may provide digital signals, such as the signal 254, to the external source which correspond to postal bar codes and key codes, 14 and 15, and, as hereinbefore described, to various positions, at respective time intervals, of the envelopes 10 and respective elements of the motor 246 and drive systems 248. In addition, the feeding structure 242 may include conventional means such as a roller 254 for feeding the respective envelopes 10 from the printing module 230. Assuming the printing module 230 is constructed and arranged for metering postage values, then, the module 230 would additionally include a pair of conventional postage credit and debit registers 256, for accounting for the total value of postage available for printing and for the total of all postage printed by the printing module 230. In addition, for postage metering purposes, the printing module 230 preferably includes conventional postage value setting structures 258 for setting the postage value that is to be printed by the module 230.

Figure 4:
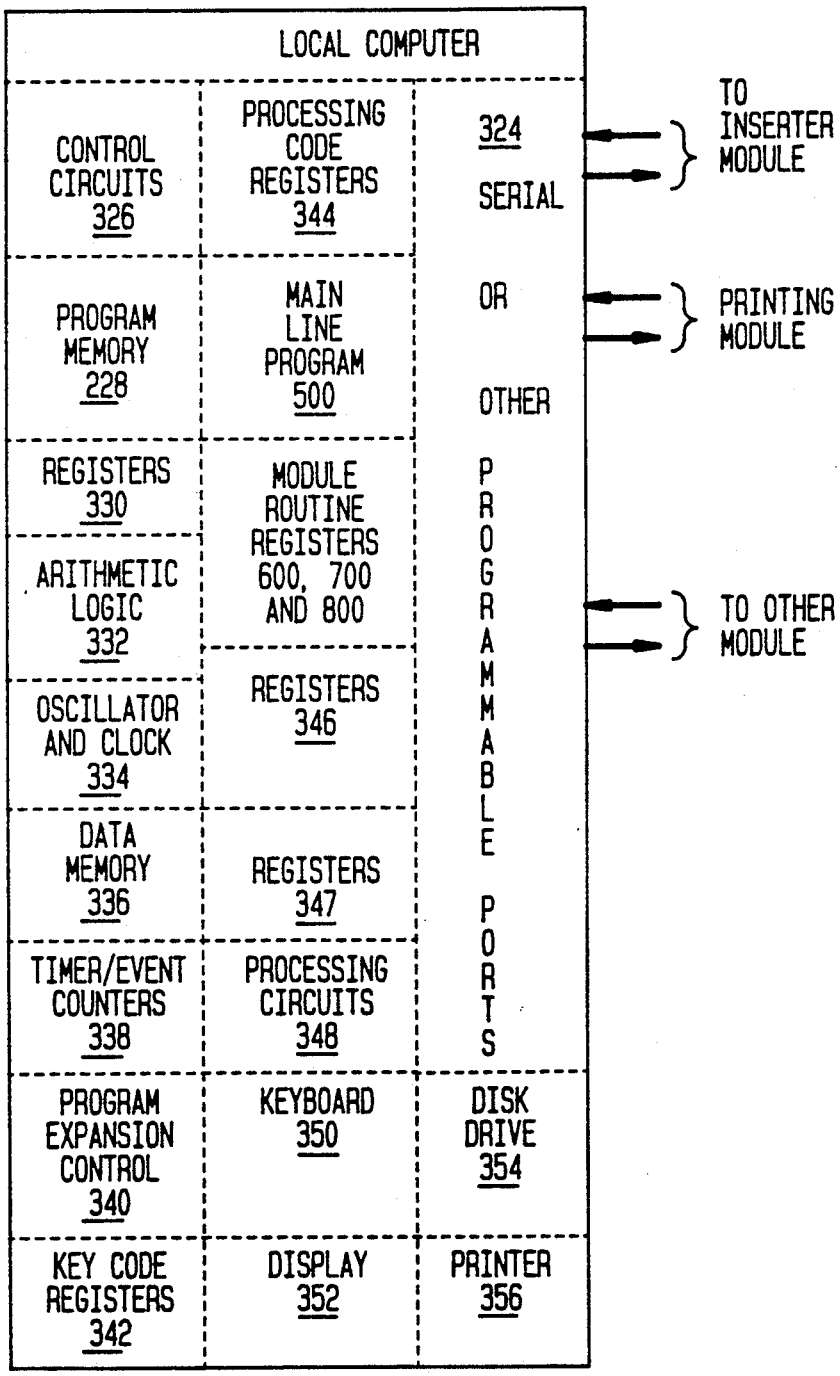
FIG. 4 is a block diagram of a local computer for controlling the apparatus shown in FIG. 2.

The systems of apparatus 20 (FIG. 2) preferably include an external source, such as the local computer 322 shown in FIG. 4, for controlling the structures and functions of the systems of apparatus 20 herein described. The local computer 322 (FIG. 4) may be any commercially available computer having a sufficient number of communication ports 324 which are programmable for serial or parallel communications, as the case may be, to provide a separate two-way serial or parallel communications link for each of the apparatus modules hereinbefore discussed. In addition, the local computer 322 generally includes a plurality of discrete circuits including those for a plurality of central processing units, each of which includes control circuits 326, a program memory 328, a plurality of registers 330, an arithmetic logic unit 332, and circuits for one or more oscillators and clocks 334, data memories 336, timers and event counters 338 and program expansion control 340. In addition, the local computer 322 includes additional registers 342 for storing listings of key codes 14, each of which preferably uniquely identifies a specific sheet 10. Further, the local computer 222 includes additional registers 344 for storing a plurality of processing codes 12, or listings thereof, each of which is related to a different one of the key codes 14. The local computer 322 also includes and a plurality of registers circuits for storing a main line program 500 and a plurality of module routines 600, 700 and 800, i.e., one for each of the apparatus modules hereinbefore described and one for any other module. In addition, the local computer 322 includes a plurality of registers 246 for future use or for use as working registers and other permanent or temporary data storage purposes. And, assuming the provision of a postage printing module 230 (FIG. 2), the local computer 322 preferably includes credit and debit registers 324 (FIG. 3) which preferably reflect the postage values stored in the postage credit and debit registers 256 (FIG. 2) of the printing module 230, and thus the total postage available for use and total postage used by the printing module 230. In addition, the local computer 322 includes a conventional local terminal which is conventionally operably interconnected to the remainder of the local computer 322. The terminal generally includes a plurality of processing circuits 348 which are conventionally interconnected to a keyboard 350, display 352, disk drive 354 and printer 356. And the local terminal is conventionally constructed and arranged to permit programming the same from a conventional disc inserted into the disk drive 354. Further the local terminal is conventionally programmed to permit the call-up and print-out, at the printer 356, in response to operator input from the keyboard 348, of the whole or any part of any information concerning the operation of any apparatus module or any list of processing or key codes 12 or 14, or any processing codes 12, and any and all information embodied in such codes, 12 and 14.

Figure 5:
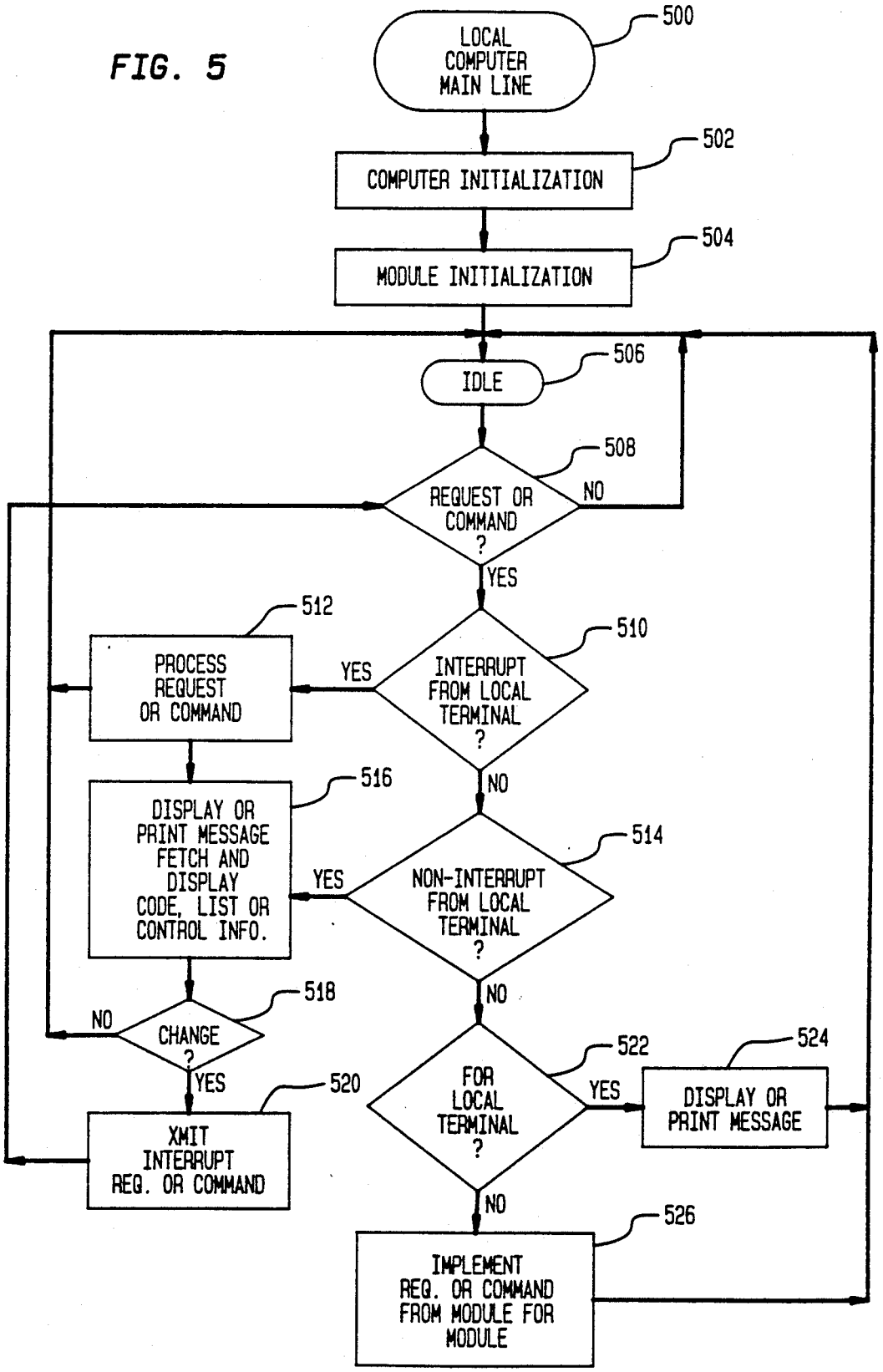
FIG. 5 is a flow chart of a main line program for the local computer of FIG. 4.
Figure 6:
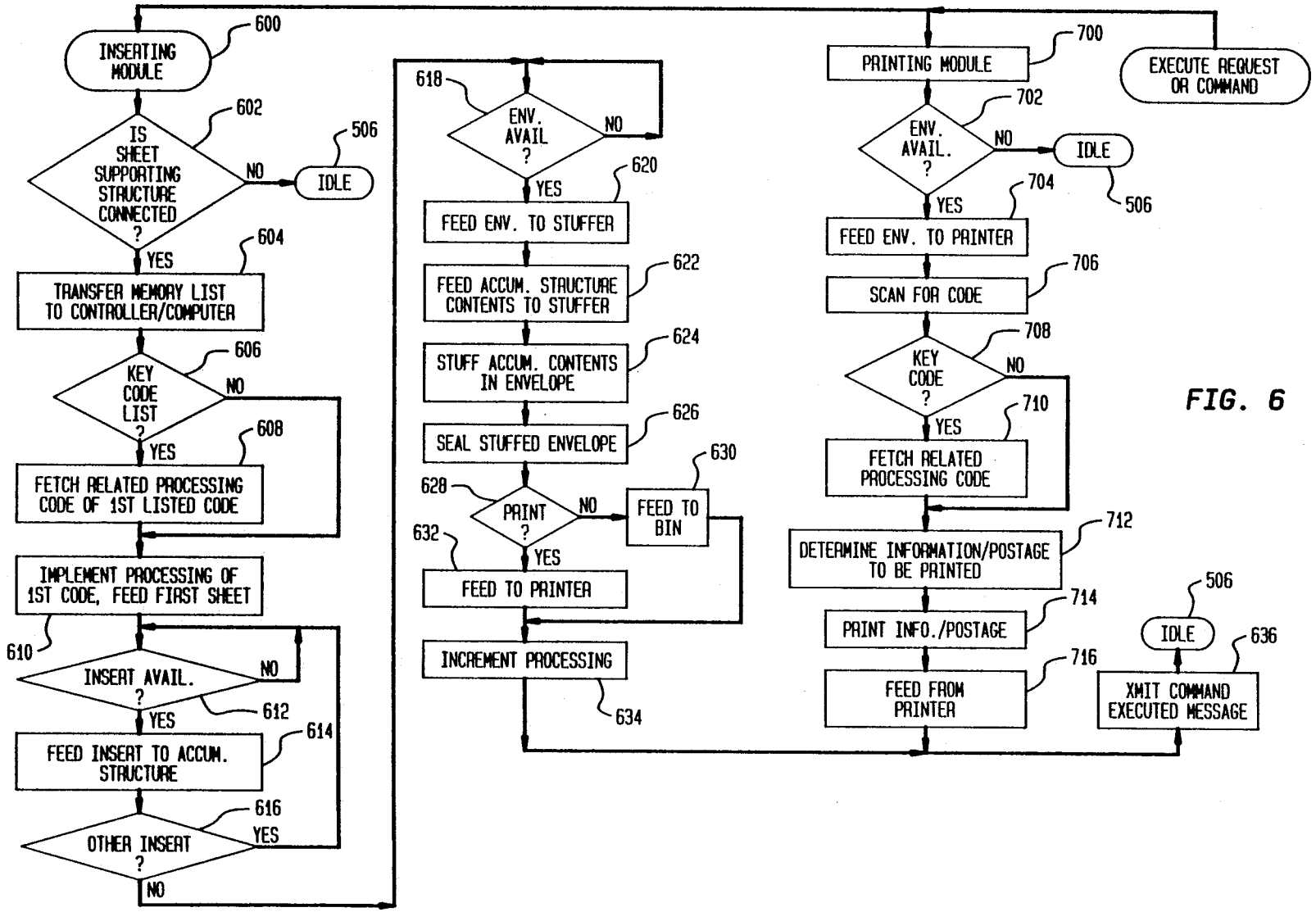
FIG. 6 is flow chart of the various apparatus module routines for controlling the system of apparatus shown in FIG. 2.

In general, the local computer 322 (FIG. 4) includes two types of software programs, i.e., a main line program 500 (FIG. 5) and a plurality of command execution routines (FIG. 6).

The local computer's main line program 500 (FIG. 5) commences with the step 502 of conventionally initializing the local computer 322 (FIG. 4), which generally includes establishing the initial voltage levels at the computer ports utilized for the control and data communications lines of the apparatus modules, and setting the timers and event counters. Thereafter the main line program 500 (FIG. 5) communicates with the respective apparatus modules and causes their respective motors and drive systems to be conventionally initialized, step 504. Step 504 entails causing the control structure microprocessors of the various modules to scan the various microprocessor ports associated with the drive systems and sensors of the modules for determining whether or not the sensed elements of the motors and drive systems, such as their respective output elements, are properly located for initiating operation of the various components of the modules and, if not, the program 500 causes the motors and drive systems to be driven to urge their respective elements, and thus the motors and drive systems, to their respective home positions.

Assuming the initialization steps 502 (FIG. 5) and 504 are completed, the program 500 enters an idle loop routine, step 506. In the idle loop routine, step 506 a determination is initially made as to whether or not a request or command has been received from one of the apparatus modules, step 508. Assuming a request or command has not been received, step 508, processing is returned to idle 506. When a request or command, step 508 is received, a determination is made as to whether or not the request or command, step 508 is an interrupt from the terminal of the local computer, step 510. Assuming the request or command is from the local terminal, step 510, then, the program 500 causes the request or command to be immediately executed, for example by causing a change to be implemented in a code or list thereof, or in operation of one of the apparatus modules, or in other control information. Assuming, however that the request or command is not an interrupt from the local terminal, step 510, then the program executes the step 514 of determining whether or not the request or command is a non-interrupt request or command from the local terminal. Assuming that it is, step 514, then the program implements the step 516 of executing the request or command, for example, for causing a message, such as a message indicating that a given sheet supporting structure 152 is filled with sheets 12, to be displayed or printed, or causing a key code, or processing code and related information, to be fetched and displayed or printed. Thereafter the program implements the step 518 of determining whether or not a program change is to be implemented, and, assuming that no such change is to be implemented, based upon operator input, processing is returned to idle, step 506. Assuming, however that, based upon operator input, a change is to be made in the programming, then the change is formulated as an interrupt request or command and the program causes processing is to be transferred to step 508. Whereupon the request or command is processed immediately, i.e., out of turn with all other unexecuted requests or commands. Accordingly, if a displayed or printed message calls for the operator to act in response to it, without changing programming, then, the operator would respond. On the other hand, if such a change is to be made, step 518, then, in response to operator input from the local terminal, or prior programming, the program 500 causes processing to be immediately implemented for example, to change the operation of a given apparatus module in response to sensing a processing or key code, or to change the order to codes of a given listing of key codes or processing codes. Returning to step 514, if a determination is made that the request or command, step 508 is not from the local terminal, then, the program implements the step, 522, of determining whether or not the request or command is for the local terminal, and, assuming that it is, the program implements the step, 524, of displaying or printing the message, followed by returning processing to idle, step 506. If however, the request or command is not for the local terminal, step 522, then it is necessarily from one of the apparatus modules, is concerned with the operation thereof and is for execution under the control of the local computer. Accordingly, the program 500 causes the request or command to be executed, step 526, by calling up the appropriate apparatus module routine 550 (FIG. 9*a*) 600 or 700 as the case may be.

As shown in FIG. 5 requests and commands from the various apparatus modules that are for the modules and not directed to use of the local terminal, step 526, are normally handled by the local computer on a first-come, first-serve basis, whereas requests or commands from the keyboard may, at the option of the operator, be handled on an interrupt basis. Moreover, it is within the scope of the invention to handle specific request or commands from the modules which are concerned with the operation thereof on an interrupt basis, for example, a module shut down message. In any event, in the preferred embodiment the local computer 322 (FIG. 4) has the capacity to handle parallel processing of requests and commands from and for the apparatus modules, as a result of which the local computer response time for execution of any given request or command does not in any event have an effect upon the timeliness of the sheet processing functions of the respective modules.

Assuming the inserting module routine 600 (FIG. 6) is called up, a determination is initially made, step 602, as to whether or not sheet supporting structure 122 (FIG. 2) is connected to the inserting module. Assuming that it is not, step 602 (FIG. 6) processing is returned to idle, step 506, until such time is the sheet supporting structure is connected to the inserting module, to permit the program 500 (FIG. 5) to execute the next request or command. Assuming the sheet supporting structure is connected to the inserting modules, step 602 (FIG. 6) the routine 600 implements the step 604 of causing the list of codes stored in the memory structure 162 (FIG. 3) of the sheet supporting structure 122 to be transferred to the control structure 102 of the inserter module 100 or to the local computer 322 (FIG. 4), or both, whereupon the routine 600 (FIG. 6) implements the step 606, of determining whether or not the transferred list is a list of key codes 14 (FIGS. 1*a*, 1*b* or 1*c*). Assuming that it is a list of key codes 14, then, the routine 600 (FIG. 6) implements the step 608 of causing processing code 12 related to the key code to be fetched from storage in the local computer, followed by causing the inserting modules to implement the processing steps, called for by the related processing code, on the first sheet in the sheet supporting structure, including feeding the first sheet from the sheet supporting structure step 610 to the accumulating structure of the inserting module. If however, with reference to step 606, the transferred list of codes is not a list of key codes then, it is assumed that the list is a list of processing codes. Accordingly, the routine causes the inserting module to immediately implement step 610, as hereinbefore discussed. Typically, the continued implementation of step 611, i.e., causing the inserting module to process the first sheet of the sheet supporting structure in accordance with the processing code therefor, would include the step 612 of determining whether or not an insert sheet which is required to be collated with the first sheet. Assuming an insert sheet is required to be collated, but is not available, processing is looped through step 612 until the insert sheet is aVailable for feeding. Assuming that the insert sheet identified by the first processing code is available, step 612, then, that insert sheet is fed from an insert station to the accumulating structure, step 614 for collation with the first sheet from the sheet supporting structure. Thereafter the routine implements the step 616 of determining which, if any, other sheets are to be collated with the sheets already fed to the accumulating structure. Assuming other sheets are to be collated, step 616, the routine loops to step 612 to implement the successive steps 612 and 614 of determining whether or not the insert sheet is available and, when it is, causing the insert sheet to be fed to the accumulator, followed by again inquiring, step 616, whether or not the processing code calls for yet another insert sheet to be fed to the accumulating structure. Assuming all insert sheets have been fed to the accumulating structure, and no other insert sheets need be fed, step 616, the routine proceeds to execute the step 618 of determining whether or not an envelope is available for stuffing thereinto the sheets in the accumulating structure. Assuming that an envelope is not available, step 618, the routine continues to loop through step 618 until an envelope is available. Whereupon, the routine executes the successive steps 620, 622 and 624 of causing the inserting module to feed the envelope to the stuffing structure, causing the inserting module to feed the contents of the accumulating structure to the stuffing structure and causing the inserting module to stuff the accumulated sheets into the envelope, followed by the step 626 of causing the module to seal the stuffed envelope. Thereafter, the routine implements the step 628 of determining whether or not the processing code for the first sheet indicated that information or postage is to be printed on the envelope. Assuming that it is not, the routine executes the step 630 of causing the module of feed the stuffed envelope to the bin 228 (FIG. 2). Assuming, however, that information/postage is to be printed on the envelope, then, the envelope is fed to the printing module, step 632. After feeding the stuffed envelope to the bin or printing module, steps 630 or 632, as the case may be, the routine implements the step 634 of incrementing the processing code for the commencement of processing of the second sheet in the sheet supporting structure, followed by the successive steps 636 and 506 of transmitting a message to the local computer indicating that the first sheet in the sheet supporting structure has been processed and returning processing to idle.

Assuming the next sheet processing module is a printing module 290 (FIG. 2), and a request or command is directed to the software routine 700 (FIG. 6) of that module, then, the printing module routine 700 is called up. Whereupon the routine 700 executes the initial step 702 of determining whether or not a stuffed envelope is available. Assuming that it is not, the routine returns processing to idle 506 until a stuffed envelope is available, step 702. If however, a determination is made that an envelope is available, then, the routine executes the step 704 of causing the feeding structure of the printing module to feed the envelope into the module. As the envelope is being fed, the routine executes the successive steps 706 and 708 of causing the sensing structure of the module to scan the envelope for the code printed thereon and make a determination as to whether or not a key code is found. Assuming a key code is found, the routine executes the step 710 of causing the key code to be transmitted to the local computer. Thereafter, the routine executes the successive steps 712 and 714 of calling up, from the local computer, the related processing code and determining the information or postage, as the case may be, that is to be printed, followed by the step 716 of causing the module to print such information or postage, as the case may be, on the envelope. Referring to step 708, assuming a key code is not found, then, it is assumed that the scanned code is a processing code, as a result of which the routine skips steps 710 and implements the aforesaid successive steps 710 and 714 of determining and printing the information/postage on the envelope. After the printing step 714, the module executes the step 718 of causing the inserting module to feed the sheet from the printing module, followed by the successive steps 636 and 506 of transmitting a command executed message to the local computer and returning processing to idle.

In accordance with the objects of the invention, there has been described improvements in methods and apparatus for simplifying and controlling an inserter, matching selected sheets therein, preparing mailpieces, and utilizing any sheet feeding station for supplying a processing code for a collation of sheets.

I claim:

1. Apparatus for processing sheets, comprising:

a. means for feeding sheets in a downstream path of travel;

b. at least two means for supporting sheets located adjacent to said path of travel, each of said supporting means having stacked therein a plurality of sheets, at least one of said sheet supporting means including electronic means for storing data relating to each sheet therein, said data including information individually identifying respective sheets in said at least one sheet supporting means and an order in which said respective sheets are stacked; and means for controlling operation of the apparatus, and said controlling means including means for causing said data to be stored therein.

2. The apparatus according to claim 1, wherein said controlling means includes means for utilizing said data for causing said feeding means to selectively feed into said path of travel at least one sheet from said at least one of said sheet supporting means and at least one sheet from one other of said sheet supporting means.

3. The apparatus according to claim 2, wherein each sheet in said at least one sheet supporting means is an envelope.

4. The apparatus according to claim 1, wherein each sheet in said at least one sheet supporting means is an insert sheet.

5. The apparatus according to claim 1, wherein each sheet in said at least one sheet supporting means includes is a collation of sheets.

6. The apparatus according to claim 1, wherein said at least one sheet supporting means is removably connectable to said apparatus, and said data storing means is connected in communication with said controlling means when said at least one sheet supporting means is connected to said apparatus.

7. The apparatus according to claim 1, wherein respective sheets in said at least one sheet supporting means each include an individual key code, and said stored data includes a list of processing codes each related to a different individual key code.

8. The apparatus according to claim 1, wherein each sheet has a code marked thereon for identification thereof, said data relating to each sheet including identifying information therefor, said controlling means including means for sensing the respective codes marked on said sheets, and said controlling means responsive to each match of a code of a sheet and identifying information therefor for processing thereof.

9. The apparatus according to claim 7, wherein said data relating to said respective sheets includes information concerning the collation thereof with at least one sheet of one other of said sheet supporting means.

10. The apparatus according to claim 2 including means for sealing envelopes.

11. The apparatus according to claim 2 including means for printing on at least one envelope.

12. The apparatus according to claim 1 including means for stuffing at least one sheet into an envelope.

13. The apparatus according to claim 1, wherein said data relating to respective sheets includes information for processing thereof, and said controlling means including means for utilizing said data for causing said apparatus to process said respective sheets.

14. Apparatus for processing sheets, comprising:

a. means for feeding sheets in a downstream path of travel;

b. at least two sheet supporting means, each of said sheeting supporting means having stacked therein a plurality of sheets, at least one of said sheet supporting means including electronic means for storing data relating to each sheet therein, said data including information providing criteria for processing respective sheets in said at least one sheet supporting means, said at least one sheet supporting means removably connectable to said apparatus; and c. means for controlling said apparatus in accordance with said data.

15. The apparatus according to claim 14, wherein each sheet in said at least one sheet supporting means is an envelope.

16. The apparatus according to claim 14, wherein each sheet in said at least one sheet supporting means is an insert sheet.

17. The apparatus according to claim 14, wherein each sheet in said at least one sheet supporting means includes a plurality of sheets.

18. The apparatus according to claim 14, wherein respective sheets in said at least one sheet supporting means include a code for identifying said respective sheets.

19. The apparatus according to claim 14, wherein said apparatus controlling means includes means for controlling said feeding means, said data storing means connected in communication with said apparatus controlling means when said at least one sheet supporting means is connected to said apparatus, and said means for controlling said feeding means including means for utilizing said data for causing said feeding means to selectively feed respective sheets from said at least one of said sheet supporting means and into said path of travel.

20. The apparatus according to claim 17 including means for stuffing at least one insert sheet into at least one envelope.

21. The apparatus according to claim 15 including means for sealing envelopes.

22. The apparatus according to claim 14 including means for printing on envelope.

23. Apparatus for processing sheets, comprising:

a. means for feeding sheets in a downstream path of travel;

b. at least two means for supporting sheets located adjacent to said path of travel, each of said supporting means having stacked therein a plurality of sheets, at least one of said sheet supporting means including electronic means for storing data relating to each sheet therein, said data including information individually identifying and providing criteria for processing respective sheets in said at least one sheet supporting means and an order in which said respective sheets are stacked, whereby each successive sheet in said at least one sheet supporting means may be individually identified and processed in accordance with said criteria; and c. means for controlling operation of the apparatus, and said controlling means including means for causing said data to be stored therein.

24. Apparatus for processing sheets, comprising:

a. means for feeding sheets in a downstream path of travel;

b. at least two sheet supporting means, each of said sheet supporting means having stacked therein a plurality of sheets, at least one of said sheet supporting means including electronic means for storing data relating to each sheet therein, said at least one sheet supporting means removably connectable to said apparatus; and c. the electronic means having stored therein a unique three-of-nine code for each sheet of the stack, the respective codes including said data relating to each sheet, and the data relating to each sheet including information relating to processing thereof by said apparatus.

25. Apparatus for processing sheets, comprising:

a. means for feeding sheets in a downstream path of travel;

b. at least two sheet supporting means, each of said sheet supporting means having stacked therein a plurality of sheets, at least one of said sheet supporting means including electronic means for storing data relating to each sheet therein, said at least one sheet supporting means removably connectable to said apparatus;

c. means for controlling said feeding means, said data storing means connected in communication with said controlling means when said at least one sheet supporting means is connected to said apparatus, said controlling means including means for utilizing said data for causing said feeding means to selectively feed respective sheets from said at least one of said sheet supporting means and into said path of travel; and d. said data including information identifying respective sheets in said at least one sheet supporting means and an order in which said respective sheets are stacked.

26. Apparatus for processing sheets, comprising:

a. means for feeding sheets in a downstream path of travel;

b. at least two sheet supporting means, each of said sheet supporting means having stacked therein a plurality of sheets, at least one of said sheet supporting means including electronic means for storing data relating to each sheet therein, respective sheets in said at least one sheet supporting means including a code for identifying said respective sheets, said at least one sheet supporting means removably connectable to said apparatus; and c. said data relating to said respective sheets including information concerning the collation thereof with at least one other sheet of one other of said sheet supporting means.

* * * * *